United States Patent [19]

Karuga et al.

[11] Patent Number: 4,892,048

[45] Date of Patent: Jan. 9, 1990

[54] AUTOMATIC THREAD TIGHTENING DEVICE FOR A SEWING MACHINE

[75] Inventors: Noboru Karuga, Hachioji; Kazumasa Hara, Hino; Mikio Koike, Qume; Mitsuru Nishijima, Tachikawa, all of Japan

[73] Assignee: Janome Sewing Machine Co., Ltd., Tokyo, Japan

[21] Appl. No.: 312,899

[22] Filed: Feb. 17, 1989

Related U.S. Application Data

[63] Continuation-in-part of Ser. No. 109,929, Oct. 19, 1987, abandoned.

[30] Foreign Application Priority Data

Oct. 24, 1986 [JP] Japan ..... 61-251589

[51] Int. Cl.[4] ..... D05B 47/04

[52] U.S. Cl. ..... 112/254

[58] Field of Search ..... 112/254, 253, 302, 255, 112/453

[56] References Cited

U.S. PATENT DOCUMENTS

| | | | |
|---|---|---|---|
| 4,328,756 | 5/1982 | Boyd | 112/254 |
| 4,690,083 | 9/1987 | Hara et al. | 112/254 |
| 4,702,185 | 10/1987 | Hanyu et al. | 112/254 |

*Primary Examiner*—Andrew M. Falik

*Attorney, Agent, or Firm*—Michael J. Striker

[57] ABSTRACT

A sewing machine having an upper thread supply, a main thread take-up lever and a needle, is provided with an automatic upper thread tension device for absorbing slackening of the upper thread during its supplying phase. The tension device includes a thread tension member arranged between the upper thread supply and the main thread take up lever to impart an adjustable pretension to the upper thread. A thread presser is arranged laterally of the path of the upper thread between the main thread take-up lever and the needle to guide the upper thread from the thread tension member to the main thread take-up lever and to clamp the upper thread and release the same during the predetermined supplying phase. An auxiliary thread take-up lever is arranged between the main take-up lever and the needle and cooperating with a thread guide to draw the slackened part of the upper thread against the guide during the supplying phase.

1 Claim, 6 Drawing Sheets

AUTOMATIC THREAD TIGHTENING DEVICE FOR A SEWING MACHINE

CROSS-REFERENCE TO RELATED APPLICATIONS

This is a continuation-in-part of application Ser. No. 109,929, filed Oct. 19, 1987, now abandoned.

BACKGROUND OF THE INVENTION

The present invention relates to a sewing machine having an automatic thread tightening device which supplies an upper thread in a suitable length required for forming stitches.

A conventional sewing machine having an automatic thread tightening device forms proper stitches by crossing an upper thread and a lower thread almost at a center of the thichness of a fabric to be sewn. A detecting device of stitching conditions detects fabric feed amounts, needle swinging, fabric thickness and thread thickness. A selecting input device controls thread tension through an upper thread tension member or an upper thread supply device in response to the stitching conditions. The upper thread tension member is in the form of a pair of spring biased disks which frictionally clamp the upper thread. The clamping pressure is controlled in response to the detected stitching conditions. Data corresponding to the detected stitching conditions are processed by a computer which delivers a control signal to the selecting input device to set the clamping pressure at the most optimum level for a particular stitching condition. Arrangements of this kind are known from U.S. Pat. Nos. 4,690,083 and 4,321,307 the entire disclosures of which are incorporated herein by reference. However, such arrangements are very complicated in structure, and encounter difficulties when threads of different materials are used.

SUMMARY OF THE INVENTION

An object of the invention is to provide a sewing machine with an automatic thread tightening device of a simple structure, which supplies proper length of the thread in response to changing stitching conditions.

Another object of the invention is to improve reliability of operation even if the threads are made of various materials.

The sewing machine is provided with a vertically reciprocating needle, a thread catching instrument for holding a lower thread and cooperating with the needle, and a main thread take-up lever cooperating with the needle thread catching instrument. The automatic thread tightening device of the sewing machine includes an upper thread supply, an upper thread tension member, a thread presser, and an auxiliary take-up lever cooperating with the main take-up lever. The upper thread tension member gives a weak resistance to the feed of the upper thread upstream of the main thread take-up lever. The thread presser which normally holds the upper thread under pressure, is controlled by a detector of rotation phase of an upper shaft, to release the upper thread during its supplying phase.

After a preceding stitch has been tightened by the main take-up lever, a length of the upper thread required for a next stitch is supplied in such a manner that the thread presser located downstream of the thread supply is made inoperative to release the upper thread during a predetermined thread supplying phase during which the main thread take-up lever comes down, and simultaneously the auxiliary thread take-up lever is operated to absorb the slackened thread between the thread presser and the stitch to be formed.

DETAILED DESCRIPTION OF THE PREFERRED EMBODIMENTS

Figure 1:
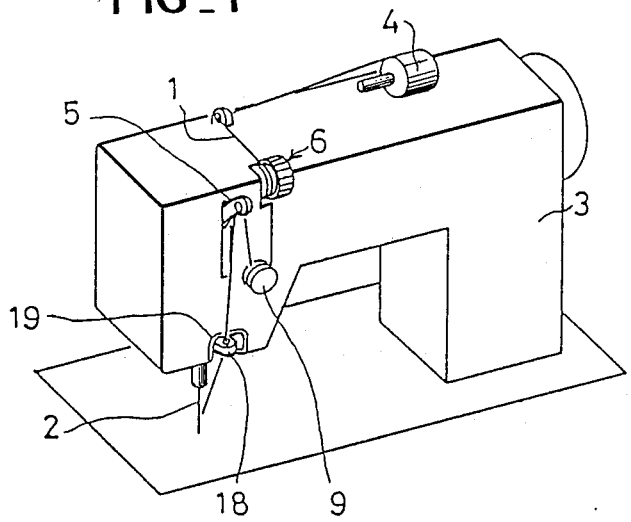
FIG. 1 is a perspective view of a first embodiment of the invention.

A sewing machine is provided with a conventional thread catching instrument (not shown) which forms locked stitches in cooperation with a needle 2. A main thread take-up lever 5 is driven in synchronism with the needle 2 and is located in an upper thread running path downstream of a thread supply 4 on the machine frame 3. An upper thread tension member 6 has a structure known from prior art. It holds by friction upper thread 1 supplied from the thread supply 4, between a pair of spring biased thread tension discs *7a* and *7b*, and controls pressure of a biasing spring by the adjustment of a thread tension dial 8.

Figure 4:
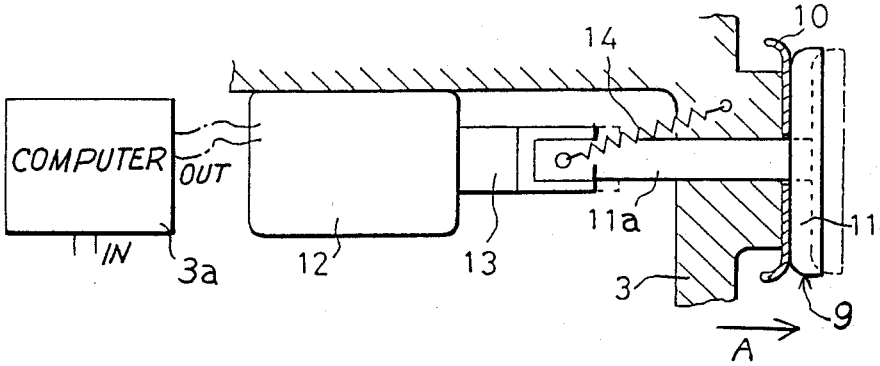
FIG. 4 is a sectional view of a thread presser.

A thread presser 9 has a structure as shown in FIG. 4. It includes an abutment disk 10 fixedly mounted on the machine frame 3. A shaft 11*a* is slidably guided in the machine frame and passes through a central opening of the abutment disk 10. A disk 11 of a frictional material is secured to the end of shaft 11*a* opposite the abutment disk. The other end of the shaft 11*a* is connected with a plunger 13 of a solenoid 12. A spring 14 is provided between the other end of the shaft 11*a* and the machine frame 3, to bias the shaft 11*a* in the direction indicated by arrow A.

Figure 5:
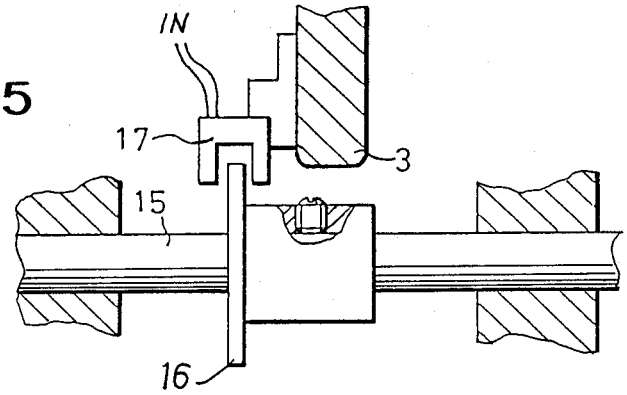
FIG. 5 is a side view, partly in section, of a device for detecting a rotary phase of an upper shaft.

FIG. 5 shows a detecting device for determining rotation phase or angle of the upper shaft 15 which is supported for rotation on the machine frame 3. The detecting device includes a photo-sensor 17 for sensing marks on a rotary disk 16 attached to the shaft 15. Signals from the sensor 17 are delivered to an input of a computer 3*a* (FIG. 4) which determines from the count of the signals momentary angular positions or phases of the shaft. The output signal from the computer controls the solenoid 12.

Figure 3:
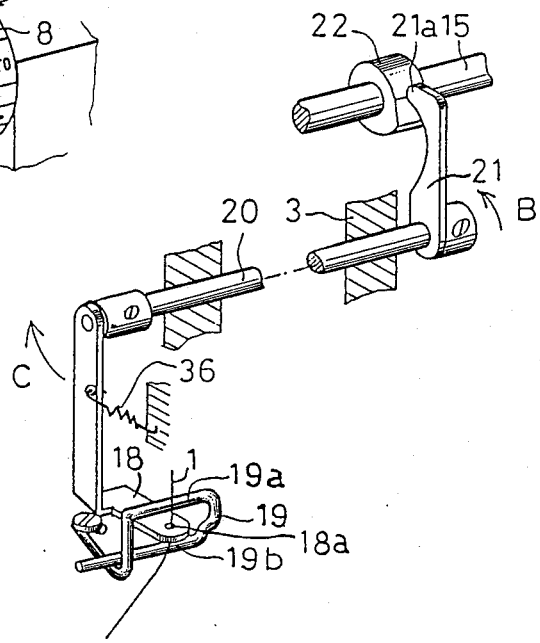
FIG. 3 is a perspective view of the structure of an auxiliary thread take-up lever.

An auxiliary thread take-up lever 18 (called "auxiliary lever" hereinafter) shown in FIG. 3 is provided between the main thread take-up lever 5 and the needle 2, and it is formed with a thread hole 18*a* at its end. The other end of lever 18 is fixed to a cam shaft 20 which is rotatably supported on the machine frame 3. The cam shaft 20 is connected at its other end with a lever 21 having a pawl 21*a* at its free end. The cam shaft is biased in the direction of arrow B by a spring 36 provided between the auxiliary lever 18 and the machine frame 3, so that the pawl 21*a* is urged against a cam 22 mounted on the upper shaft 15.

It will be seen from FIG. 1, the thread presser 9 is located laterally of the path of the upper thread portion between the main take-up lever 5 and the auxiliary take-up lever 18.

An explanation of the control of the upper thread, will be made referring to FIGS. 6 to 8.

Figure 7:
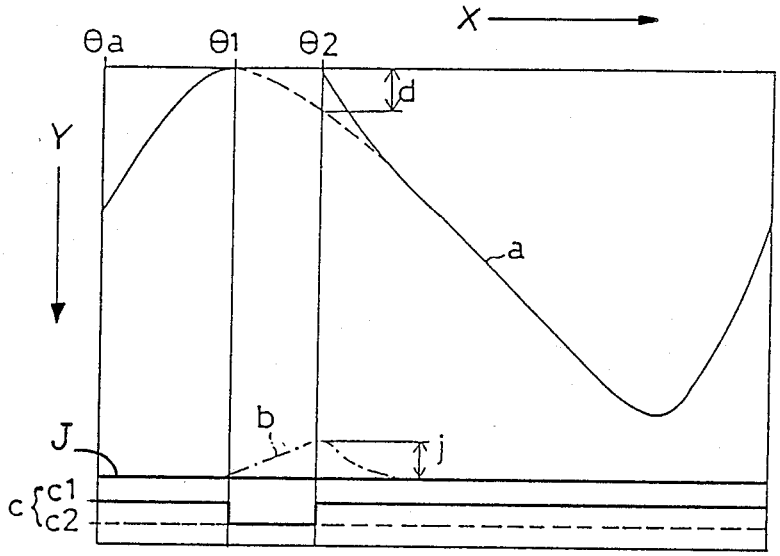
FIG. 7 is a diagrammatic view showing an upper thread supplied by the main thread take-up lever and its slack being timingly absorbed by the auxiliary thread take-up lever when the thread presser is inactivated.

The horizontal axis X of FIG. 7 shows angular positions or phases of shaft 15. Phase $\theta a=0°$ denotes an upper dead point phase of the shaft 15 detected by the rotation phase detecting device 16, 17 (FIG. 5). In FIG. 7, "a" denotes a length of the upper thread supplied to needle 2 by the actuation of the main thread take-up lever 5, "b" denotes a length of the upper thread absorbed and released by the auxiliary lever 18 and "c" indicates an actuation levels of the thread presser 9 where "c1" indicates the condition when the thread presser 9 is operative, and "c2" indicates the condition when it is inoperative.

As generally known, the main thread take-up lever 5 is reciprocated vertically by rotation of the upper shaft 15 to control the upper thread according to the curve "a", shown in FIG. 7. The thread presser 9 is brought into its actuated state as shown with full line "c1" in FIG. 7 when the solenoid 12 is energized in response to an order from the calculation or computer device 3*a* to attract the plunger 13 against biasing force of the spring 14, whereby the presser disk 11 is moved in opposition to the direction of arrow A until the upper thread 1 is clamped between the disc 10 and the disc 11 as shown in full line in FIG. 4. The thread presser 9 is returned to its inoperative state as shown with dotted line "c2" in FIG. 7, when the solenoid 12 is deenergized in response to an order from the calculation device and the disk 11 is returned to its thread releasing position as shown with the dotted line in FIG. 4, the plunger 13 and the shaft 11*a* are moved in the direction of arrow A to release the upper thread 1.

The fabric is fed from the upper dead point $\theta 1$ of the main thread take-up lever 5 where the latter is at its highest position for tightening the stitches, and the fabric feed is stopped at a phase $\theta 2$ where the needle goes down to the center of the fabric thickness.

At the upper dead point phase $\theta a$ of the needle 2 the fabric is not fed, and the thread presser 9 is actuated as shown with c1 in FIG. 7, and the upper thread 1 is clamped between the disc 10 and the presser disk 11.

In the meantime, the auxiliary lever 18 is, as shown in FIG. 3, rotated by spring 36 in opposition of arrow C, since the pawl 21*a* of the lever 21 contacts the smallest diameter portion of the cam 22. The thread hole 18*a* of the auxiliary lever 18 remains projected beyond a thread guide 19 (FIGS. 1 and 3) which is mounted on the machine frame 3. The guide 19 has an upper guiding section 19*a* extending transversely above thread hole 18*a* in the free end of lever 18, and a lower guiding section 19*b* extending transversely below the thread hole.

Figure 6A:
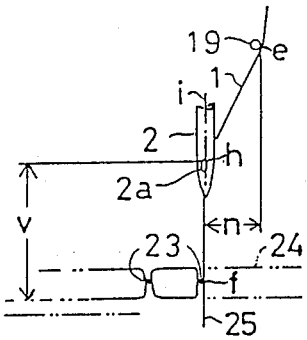
FIGS. 6A, 6B and 6C are schematic views showing the formation of stitches.

The above mentioned projected condition of lever 18 is maintained until a next upper dead point phase $\theta 1$ of the main thread take-up lever 5 is reached due to rotation of the upper shaft 15. In the meantime, the thread take-up lever 5 moves upwardly to absorb the slackened upper thread portion between the thread presser 9 and the stitch so as to minimize the slack of the thread at the upper dead point phase $\theta 1$. As shown in FIG. 6(A), the upper thread maintains tension between the thread guide 19 (point e)—the needle eye 2*a* (point h)—and a crossing point 23 (point f) of the upper and lower threads in the center in thickness of the fabric with the offset n from the thread guide 19.

After the stitch has been tightened at the upper dead point phase $\theta 1$ of the thread take-up lever 5, the thread presser 9 is made inoperative at the level c2 (FIG. 7) and releases the upper thread held between the disk 11 and the disc 10. The needle 2 goes down while the fabric is fed until the phase $\theta 2$ is reached and the needle eye 2*a* is brought to the center of the fabric thickness, and the feeding is stopped. Then the thread presser 9 is set operative again at the phase $\theta 2$ to clamp the thread.

Figure 6B:
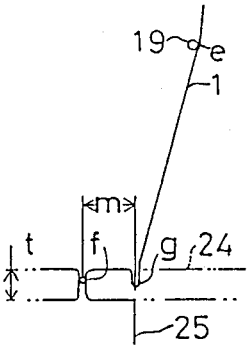
Figure 6C:
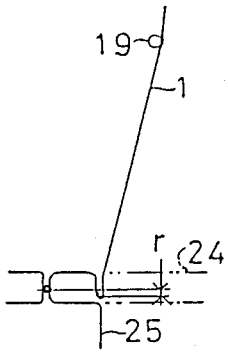

This phase $\theta 2$ is shown in FIG. 6(B). The fabric is fed by the amount m and the needle eye 2*a* (point g) is at the center of fabric thickness.

Therefore, a length of the upper thread 1 corresponding to the feed amount m and the fabric thickness t is required between the phase $\theta 1$ and the phase $\theta 2$. Since the thread presser 9 releases the upper thread 1 when the latter is tightened between the thread supply 4 and the stitch, the thread length is pulled out from the thread supply 4 by feeding the fabric under slight tension exerted by the upper thread tension member 6.

Referring to FIG. 7, the slackening of the upper thread increases as the thread take-up lever 5 moves down from the upper dead center point phase $\theta 1$, and a slack d is produced at the phase $\theta 2$. The slack d of the thread is absorbed by the auxiliary lever 18 as follows:

By the rotation of the upper shaft 15, pawl 21*a* of the lever 21 comes from the smallest portion of the cam 22 to engage the largest diameter portion of the cam whereby the lever 21 is rotated in opposition to the arrow B (FIG. 3). Consequently, the auxiliary lever 18 is rotated in the direction of arrow C, and the thread hole 18*a* of the auxiliary lever 18 is retracted behind the thread guiding sections 19*a*, 19*b* as shown with the solid line in FIG. 17. As a result, the amount j of the upper thread 1 corresponding to the slack d introduced by the thread take-up lever 5, is absorbed. Therefore, a corresponding length of the upper thread 1 is required when the fabric is transported, and is supplied from thread supply 4 when the upper thread between the phase $\theta 1$ and the phase $\theta 2$ is tightened.

At the phase $\theta 2$, solenoid 12 is energized to make the thread presser 9 operative. The actuated thread presser 9 clamps the upper thread to stop the supply thereof.

Figure 17:
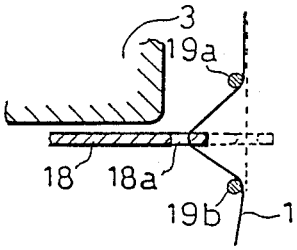
FIG. 17 is a sectional view of an auxiliary thread take-up lever.

In the meantime, pawl 21*a* slides from the largest diameter portion into engagement with the smallest diameter portion of the cam 22 to rotate the lever 21 in the direction of arrow B and the auxiliary lever 18 in opposition to the arrow C, so that the thread eye 18*a* is moved from the position shown with solid line of FIG. 17 to the position shown with dotted line so as to decrease the absorbing amount of the upper thread 1 and increase the slackening amount of the upper thread as shown in FIG. 7 to meet the conventional curve a of the slackening amount of the upper thread in response to pulling of the upper thread by the thread catching instrument (the loop taker).

The supply amount or length of the upper thread between the phase $\theta 1$ and the phase $\theta 2$ is the length supplied from a completed stitch prior to the phase $\theta 1$ and prior to moving down of the needle eye 2*a* to the center of the fabric thickness at the next stitch at phase $\theta 2$, that is represented by the thread (e-g-f)-(e-h-f) in FIGS. 6(A) and 6(B). Assuming that W is the above mentioned supply length and that P is an amount or length of the upper thread required for forming the stitches (i.e. a length required to feed the fabric by a distance m and to cover the fabric thickness t), that L is the length of the thread (e-g-f)-(e-g) and k is the stretching of the upper thread caused by the upper thread tension device 6, the supply amount W between the phase $\theta 1$ and the phase $\theta 2$ is expressed by an equation $W=P-(L+k)$. Since the upper thread is interlocked with the lower thread at the center 23 of the fabric thickness, the required length P of the upper thread lacks for or is deficient of the length $(L+k)$ wherein L is determined by the offset amount n between the thread guide 19 and the center i of the needle and the height v of the needle eye 2*a* at the upper dead point of the thread take-up lever 5, as seen in FIG. 6(A).

The stretching k of the thread is a variable value depending on the type of the threads used and on the pressure of the thread tension device 6. The tension device 6 is different from a conventional upper thread tension device which controls only the tension of the thread, in that it holds the upper thread with a slight tension only, thus preventing the upper thread from running toward the thread presser 9 when released. Therefore, according to one feature of the invention, there result only minute differences in elongation when different types of threads are used, and the length or amount $(L+k)$ to be subtracted is always constant. The length or amount $(L+k)$ of the upper thread may be compensated for by delaying the phase $\theta 2$ of the thread presser 9 (FIG. 6(C)) until the needle eye 2*a* drops by a predetermined distance r from the center of the fabric thickness, so that the thread length of 2*r* may be supplied. The determined distance r may be in advance calculated from the equation $2r=L+k$.

By this compensation, it is possible to supply the correct length of the upper thread corresponding to a length needed for stitches determined by the fabric feed and the fabric thickness without regard to the type of the stitches (e.g. straight or zig zag stitches).

Figure 2:
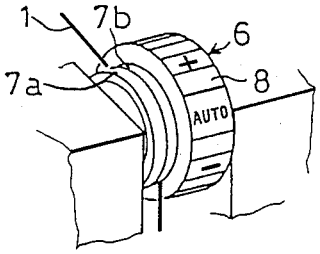
FIG. 2 is an enlarged view of an upper thread tension member.
Figures 8A, 8B, 8C:
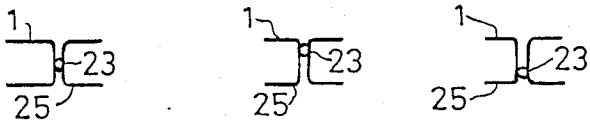
FIGS. 8A, 8B and 8C show crossing points of stitches.

The preceding embodiment shows a case of obtaining proper stitches where the crossing point of the interlocked upper and lower threads comes to the center of the thickness of the fabric as shown in FIG. 8(A). The crossing point may be changed upward (FIG. 8(B)) or downward (FIG. 8(C)) by rotating a thread tension dial 8 (FIG. 2) of the upper thread tension device 6 so as to change the tension of the upper thread supplied when the thread presser 9 has been released. An external manually operated part may be provided and connected to an actuation control part of the thread presser 9 to manually control the actuation phases of the presser 9.

Figure 9:
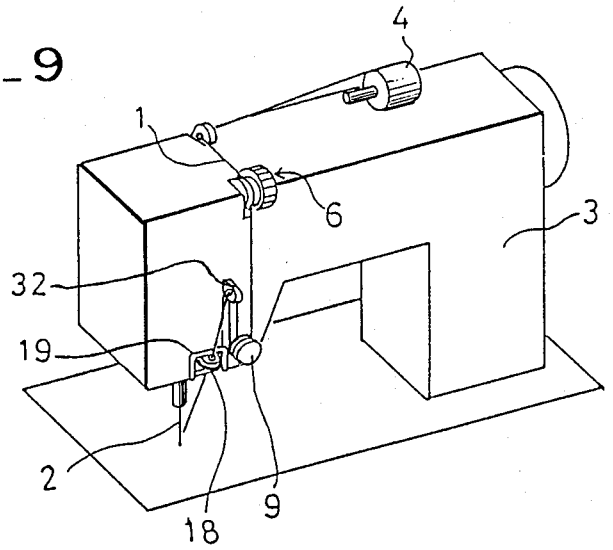
FIG. 9 is a perspective view of a second embodiment of the invention.

A further explanation will be made to a second embodiment of the invention with reference to FIGS. 9 and 10. This second embodiment has the same structure as the first embodiment except for a thread take-up lever.

In comparison with the first embodiment, the thread take-up lever 32 in the second embodiment is positioned nearer to the auxiliary lever 18 and the thread presser 9, so that the length of the upper thread running paths between lever 32 and presser 9 as well as between lever 32 and auxiliary lever 18 may be shortened and the length of the thread to be taken-up by the lever 32 is shortened accordingly to neutralize the elongation of the upper thread which may be caused by tensioning the lower thread.

Figure 10:
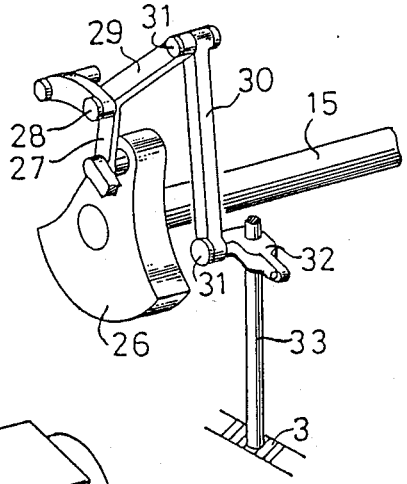
FIG. 10 is a perspective view of a drive part of a thread take-up lever to be used in the second embodiment.

As shown in FIG. 10 the thread take-up lever 32 is linked via an articulated connection with a crank 26 mounted on the upper shaft 15. The articulated connection includes a rod 30 pivotably connected by pin 31 to one end of lever 32 and by pin 31 to a link 29. The link 29 is pivotably connected by a pin 28 to crank rod 27 which is journelled to the crank 26.

The thread take-up lever 32 is slidably mounted on a vertical shaft 33 secured to the machine frame 3 and vertically reciprocated in response to the rotation of the upper shaft 15. The thread eye 32*a* of the thread take-up lever 2 in this second embodiment is moved near the auxiliary lever 18 and the thread presser 9, so that the thread path from the thread presser 9 to the stitches is shortened and the elongation of the upper thread is reduced accordingly.

Figure 12:
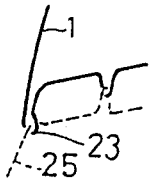
FIG. 12 is an explanatory view showing upper and lower threads interlocked with each other just before the upper thread is pulled up by the main thread take-up lever.
Figure 11:
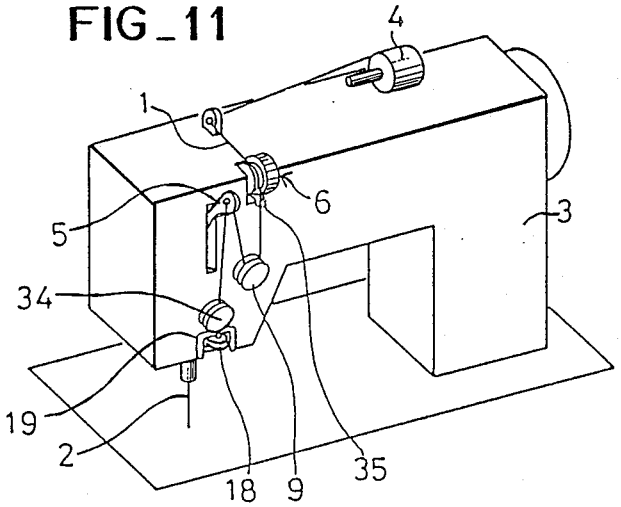
FIG. 11 is a perspective view of a third embodiment of the invention.

A third embodiment will be described with reference to FIGS. 11 to 13. As seen in FIG. 11, a second thread presser 34 of the same structure as the thread presser 9 is provided between the thread take-up lever 5 and the auxiliary lever 18, and a thread regulating spring 35 is provided in the thread running path between the upper thread tension device 6 and the thread presser 9.

The second thread presser 34 is employed for adjusting the phase of tightening of the auxiliary thread take-up lever 18.

The operation of this third embodiment will be explained with reference to the graph of FIG. 13 wherein X-axis indicates rotation angles or phases of the upper shaft 15; Y-axis indicates the supply of the upper thread; reference characters J and J1 indicate the zero and end levels of the slack absorption of the upper thread; respectively; "a" is a curve of the upper thread released by the lever 5; "b" is a curve of the slack of the upper thread absorbed by means of the auxiliary lever 18; "c" indicated actuated (c1) and inactuated (c2) levels of the thread presser 9; "s" indicates actuated (s1) and inactuated (s2) levels of the second thread presser 34; and "$\theta a$" indicates a needle upper dead point. The solenoid 12 is, as shown with the solid line in FIG. 4, energized to attract the plunger 13, and the upper thread is clamped between the brim disk 11 and the disc 10 so as to prevent the upper thread from going toward the needle when the second thread presser 34 is inoperative ("s2"), and the solenoid 12 is deenergized to move disk 11 to the position indicated with the dotted line in FIG. 4, in which the upper thread 1 is released. A phase $\theta 3$ is a phase just before the upper dead point phase $\theta 1$ of the thread take-up lever 5, where the needle goes down but the needle eye has not yet come to the upper surface of the fabric, and the thread presser 9 has been inactivated to release the upper thread while the second thread presser 34 has been actuated to clamp the upper thread.

Therefore, the slackened length of the upper thread is being absorbed by the thread take-up lever 5, when the thread crossing position 23 is at the lower side within the fabric, i.e., at the phase just before the stitch is tightened.

During the interval from the phase $\theta 3$ to the phase $\theta 2$ the needle eye 2*a* comes to the center of the fabric thickness and simultaneously the auxiliary lever 18 is operated to pull the thread.

At the phase $\theta 3$, the needle 2 is coming down while the thread take-up lever 5 goes upwardly to pull up the lower thread 25 to the center of the fabric thickness, and the auxiliary lever 18 tightens the thread between the stitch and the second thread presser 34 so as to form stitches. In the meantime the upper thread 1 from the second thread presser 34 and the thread presser 9 is tightened due to the upward movement of the thread take-up lever 5.

Figure 13:
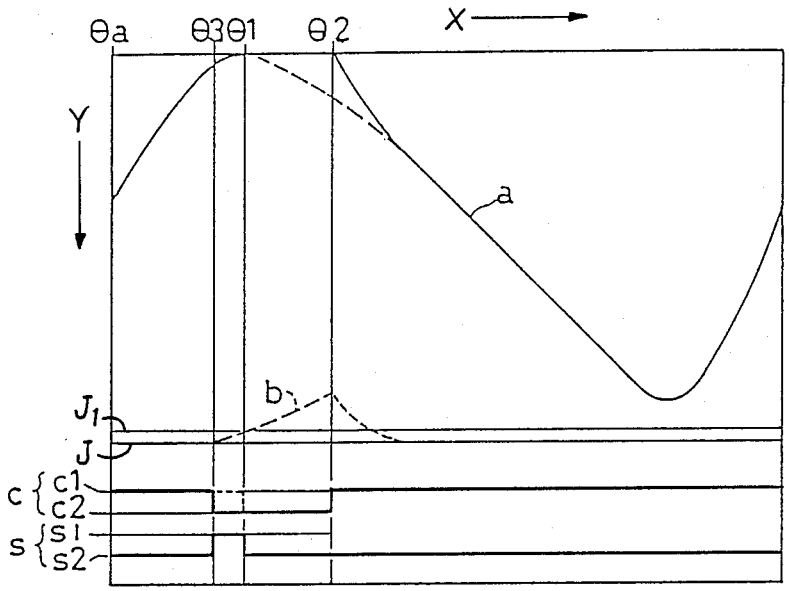
FIG. 13 is a diagrammatic view showing the upper thread supplied by the main thread take-up lever and its slack being timingly absorbed by the auxiliary thread take-up lever in the third embodiment when the first thread presser is inactive and the second thread presser is activated.

At the phase just after tightening the stitch, i.e., at the upper dead point phase $\theta 1$ of the thread take-up lever, the second thread presser 34 is inoperative, as shown with lever s2 in FIG. 13, to release the upper thread while the thread presser 9 remains inoperative to release the upper thread 1. For feeding the fabric to form the next stitch between the phase $\theta 1$ and the phase $\theta 2$, the upper thread 1 is supplied as much as required to the amount of feeding the fabric and the fabric thickness. For drawing out the upper thread 1 from the thread tension device 6, the auxiliary lever 18 absorbs, as in the first embodiment, the slackened amount of the upper thread when the thread take-up lever 5 comes down between the upper thread dead point phase $\theta 1$ of the thread take-up lever 5 and the phase $\theta 2$ at which the needle eye 2*a* comes to the center of the fabric thickness, so that the curve "a" of the upper thread in FIG. 13 is changed from the position shown with dotted line to the position shown with solid line and an adjusted length of the upper thread is supplied. The thread regulating spring 35 is employed for drawing back an excess length of the upper thread which may be supplied between the phases $\theta 3$ and $\theta 2$ due to possible difference in timing the cooperation of the second thread presser 34, thread presser 9 and the thread take-up lever 5.

The second thread presser 34 shortens the length of the upper thread to neutralize elongation caused by the tension of the lower thread.

Figure 16:
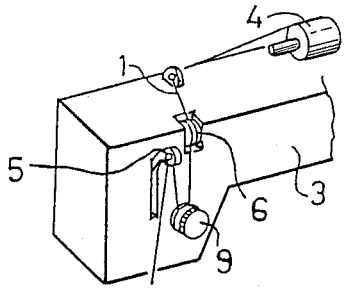
FIG. 16 is a partial perspective view of an applied example of the fourth embodiment.

A fourth embodiment of the invention will be explained with reference to FIGS. 14 to 16. This embodiment shows a thread tension adjusting device which in contrast to the first to third embodiments, is applicable only for straight stitching of about 1.8 to 2.5 mm of fabric feed.

Figure 14:
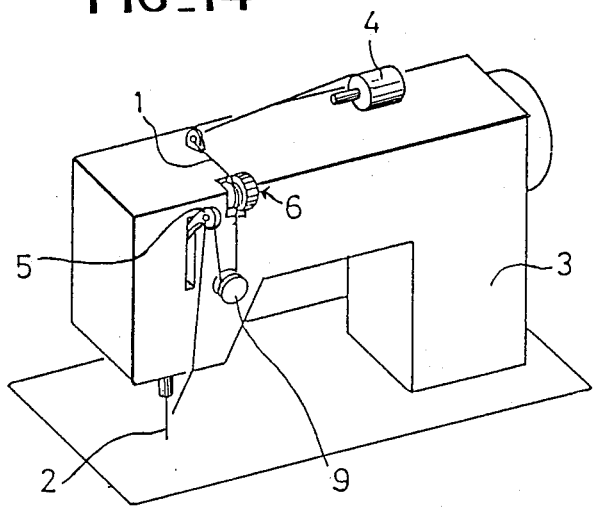
FIG. 14 is a perspective view of a fourth embodiment of the invention.
Figure 15:
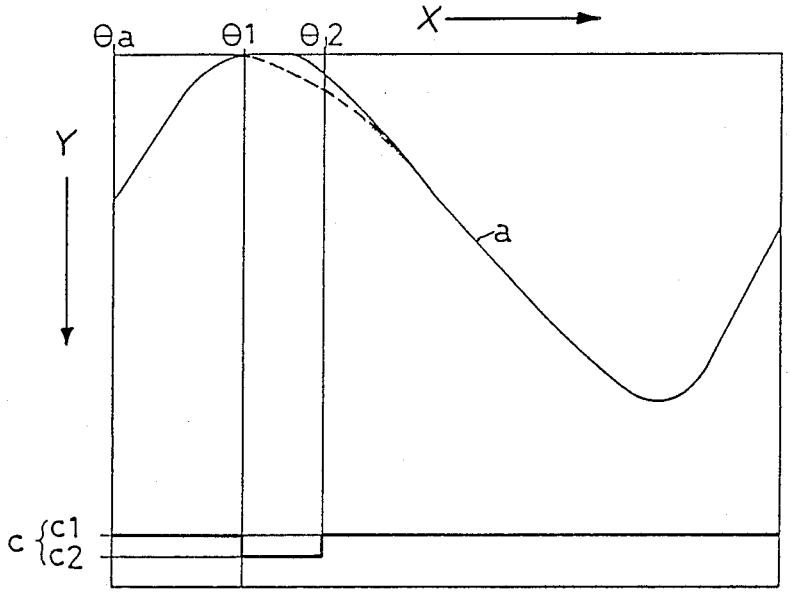
FIG. 15 is a diagrammatic view showing the upper thread supplied by the main thread take-up lever in the fourth embodiment wherein the slack is timingly absorbed by the main thread take-up lever when the thread presser is inactive.

This fourth embodiment omits, as evident from FIG. 14, the auxiliary lever 18. A thread take-up lever 5 used herein brings the slackened length of the upper thread "a" supplied to the needle eye 2*a* between the upper dead point phase $\theta 1$ and the phase $\theta 2$ (FIG. 15) is changed from the dotted line to the solid line in FIG. 15, while the thread is supplied by the thread presser 9 in the same manner as in the preceding embodiments.

We claim:

1. A sewing machine having a vertically reciprocating needle for holding an upper thread, means of carrying a lower thread and catching the upper thread to form stitches in cooperation with the needle, an upper thread supply, a main thread take-up lever, and an automatic thread tension device, said device comprising an upper thread tension member arranged in a thread running path between said upper thread supply and said main thread take-up lever; an auxiliary thread take-up lever arranged in the thread running path between said main thread take-up lever and said needle and having a thread engaging part for guiding said upper thread; a thread presser arranged laterally of the thread running path between said main and auxiliary thread take-up levers to guide said upper thread from said tension member to said main thread take-up lever, said thread presser being controlled in response to a rotation phase of an upper shaft of the sewing machine to normally clamp said upper thread and to release the same only during a predetermined phase of supplying the upper thread from said supply; a thread guide fixedly arranged adjacent to said auxiliary thread take-up lever; and said auxiliary thread take-up lever being controlled for movement relative to said thread guide into a position in which said thread engaging part cooperates with said thread guide such as to absorb a slackening of the upper thread in said thread running path between the main thread take-up lever and the needle during said supplying phase.

* * * * *